US005425851A

United States Patent [19]

Cason et al.

[11] Patent Number: 5,425,851

[45] Date of Patent: Jun. 20, 1995

[54] METHOD FOR IMPROVING THE PRINTABILITY OF WEB OFFSET PAPER

[75] Inventors: David B. Cason, Paducah, Ky.; Paul A. Huijing, Columbia, Md.; Eric D. Johnson, Flintstone, Md.; Bryan J. Ortman, Columbia, Md.; S. Craig Petro, Paducah, Ky.

[73] Assignee: Westvaco Corporation, New York, N.Y.

[21] Appl. No.: 953,254

[22] Filed: Sep. 30, 1992

Related U.S. Application Data

[63] Continuation-in-part of Ser. No. 781,575, Oct. 23, 1991, abandoned.

[51] Int. Cl.[6] ..... D21F 11/00

[52] U.S. Cl. ..... 162/206; 162/205; 162/207; 34/421; 34/446

[58] Field of Search ..... 162/205, 206, DIG. 10, 162/207, 192, 252; 100/38, 92, 93 RP; 34/421, 420, 68, 273, 446, 445

[56] References Cited

U.S. PATENT DOCUMENTS 3,124,504 3/1964 Mahoney et al. ..... 162/206

4,492,612 1/1985 Matarainen ..... 162/360.1

FOREIGN PATENT DOCUMENTS 926171 5/1973 Canada ..... 162/206

0174661 3/1986 European Pat. Off. ..... 162/205

1129733 10/1968 United Kingdom ..... 162/206

OTHER PUBLICATIONS

Hunger, Gunther Dr., Symposium on Calendering and Supercalendering of Paper, University of Manchester Institute of Science & Technology, Manchester, England Sep. 1 and 2, 1975.

*Primary Examiner*—Brenda Adele Lamb

[57] ABSTRACT

Web offset printing paper having a high level of gloss and smoothness is prepared by finishing a paper web, either by supercalender or with a synthetic roll calender at a moisture content greater than the moisture content typically used for web offset finishing, and then drying the web to a moisture content of less than about 3.5% using convection, radiation or conduction. Under the preferred post-drying conditions, bonding of the previously wet paper fibers takes place to lock in the desirable printing characteristics and to prevent heat roughening on the offset press.

17 Claims, 5 Drawing Sheets

METHOD FOR IMPROVING THE PRINTABILITY OF WEB OFFSET PAPER

BACKGROUND OF INVENTION

This application is a continuation-in-part of U.S. application Ser. No. 07/781,575 filed Oct. 23, 1991 (now abandoned), which is incorporated herein by reference.

During the web offset printing process, ink is applied to both sides of the web simultaneously, followed by relatively severe drying with high temperature air impingement. High temperature drying is required to dry the applied inks. During this drying process, the printed surface becomes roughened if the moisture content of the web is greater than about 3.5%. Similar roughening is not present in the sheet fed printing process where inks are dried more slowly by chemical curing, generally without the application of external heat. The condition of the paper printed by the web offset printing process at high moisture is said to be "heat roughened". This roughening is dependent on both paper and press parameters. The most critical paper parameter is the paper moisture entering the press. However, the press drying conditions including web exit temperature, speed, and oven temperature, also contribute to heat roughening.

The moisture content of the web entering the press plays a significant role. Paper having a moisture content above about 3.5% tends to get rougher during printing while paper with a moisture content less than about 3.5% becomes smoother upon printing. Since press conditions are difficult to change because of the need to maintain register and press productivity, this means that the papermaker must make the adjustments necessary to overcome heat roughening on the press.

SUMMARY OF INVENTION

Web offset paper for the high quality printing market must have high gloss and smoothness. Both smoothness and gloss may be enhanced during the papermaking process by finishing (calendering). The finishing may be accomplished by supercalendering or with a synthetic roll calender. Further, as in the case of the offset printing process, the moisture of the web plays an important role during finishing. Generally, paper webs finished at high moisture content have a smoother finish and greater gloss than paper webs finished at low moisture content. However, webs finished at high moisture must then be dried to reach a moisture content that will not produce heat roughening on the press. Unfortunately, when the finished web is dried, it is susceptible to the same type of heat roughening experienced during web offset printing. Thus, since moisture plays important roles in both the finishing and web offset printing processes, the problem becomes one of finishing the paper at high moisture to achieve the high gloss and smoothness desired by the printer, while still being able to deliver to the printer a web which retains as much of the gloss and smoothness as possible, at a low enough moisture content for good performance on the press. Therefore, merely finishing at high moisture is not enough, the paper must then be dried in such a manner as not to negate the improved finish achieved by high moisture finishing. This is accomplished by selecting a drying rate for the specific product and post drying method chosen to achieve the desired results.

The most commonly used method for characterizing the drying of paper webs is the average water removal rate in lb/sq. ft/hr. Unfortunately, it is not a rate constant since it is a function of both water content and web speed. However, a convenient method for the characterization of drying has been developed for an airfoil dryer which dries by convection heating. The method is based on the observation that drying of web offset coatings can be characterized as always in the falling rate period of drying, i.e., drying rate is dependent on water content. Since water content vs. residence time is linearized by a logarithmic function, a rate constant, K, may be defined which is dependent only on dryer output (i.e., dryer air temperature and velocity). This constant is not dependent on water content or web speed and may be defined by the equation:

$$K(\mathrm{hr}^{-1}) = \ln\left(\frac{W_o}{W_f}\right)t^{-1}$$

where $W_o$ is the initial moisture content entering the dryer and $W_F$ is the final moisture content (both in lb/ream), and t is the residence time in the dryer in hours. It is believed that this method would also apply to the drying of webs finished at high moisture as disclosed in the present invention. The calculation is fairly straight forward for convection dryers such as the air foil type which have a finite length during which the web is exposed to heat and moisture is removed. Knowing the length and web speed, the residence time can be readily determined. The same calculations can be made for conduction drying and radiant drying by measuring the wrap around the conduction drying drum or the length of the radiant drying unit. However, in both of the above drying methods, moisture is removed beyond the time the web is in contact with the drying apparatus. Therefore, it is recognized and understood that the most accurate calculation of a drying rate constant depends to a great extent on the drying method used. However, the performance of the present invention may be best characterized by monitoring the temperature of the web exiting the post drying apparatus. Optimum performance is achieved by using a post drying procedure which produces a web exit temperature of less than about 300° F., and preferably 200°-260° F., although web exit temperatures of less than about 200° F. should produce similar results.

In accordance with the present invention, an improved web offset printing paper is produced by finishing the web, either with a supercalender (SC) or using a synthetic roll calender (SRC), under conditions where the web has a moisture content greater than the moisture content typically used for web offset finishing (i.e. 3-5%), and less than the moisture content that would cause excessive opacity loss, blackening or galvanizing of the paper at the temperature, pressure and web speed selected, and then drying the web to a final moisture content of less than about 3.5% at a moderate and substantially uniform rate as characterized by the web exit temperature of the drying method used, as for example, using convection (i.e., air), radiation (i.e., infrared) or conduction (i.e., heated rolls), or in the form of a low pressure heated nip (i.e., gloss calender). The paper produced has a high level of gloss and smoothness and the preferred post drying conditions minimize losses of surface properties obtained by high moisture finishing. This process effectively eliminates heat roughening of the printed surface during a subsequent web offset printing process.

Heat roughening may be characterized by a loss in smoothness of the paper surface during printing as measured, for example, by its Bekk smoothness. Moreover, this same type of heat roughening may occur during any post drying step applied to a high moisture finished paper web. The Bekk smoothness test is an air leak method commonly used in the paper industry. In the Bekk test, the relative smoothness of the paper surface is measured by the time (in seconds) that it takes for a fixed volume of air to leak from between the surface of the paper and the smooth face of the Bekk instrument. The smoother the paper surface, the longer it takes for the fixed volume of air to escape.

It is known that the smoothness of a paper web may be enhanced by finishing the web at a high temperature and pressure, and at a high moisture content. Smoothness and gloss generally increase during the finishing process as the moisture content is increased within the range of from about 4–10%. Above 10% moisture, both opacity loss and blackening generally occur. The finishing according to the present invention may be by supercalender or by a synthetic roll calender since either method may be practiced to yield about the same improvements in finish. However, finishing at high moisture to improve the smoothness of the paper web entering the press does not solve the heat roughening problem which occurs during web offset printing. In fact, there appears to be a relationship between the heat roughening effect during web offset printing and the moisture content of the web entering the press. If the moisture content of the web entering the press is greater than about 3.5%, the printed smoothness will almost always be less than the unprinted smoothness, notwithstanding the improvements achieved by high moisture finishing. Meanwhile, if the web is dried to a moisture content of less than about 3.5% before printing, the printed smoothness will almost always be greater than the unprinted smoothness. However, the smoothness gained by high moisture finishing is affected by the rate of drying during any post drying step used to reduce the moisture to 3.5% or less for printing. Therefore, to achieve the best results with the present invention, the web is preferably finished at a high moisture content in the range of from about 4–10%, and then moderately and uniformly dried to a moisture content of 3.5% or less in such a manner that losses in the smoothness gained by high moisture finishing are minimized. The post drying step may be carried out with any number of available methods or combinations thereof, including radiation, convection, and conduction.

The amount of finishing needed in the present invention is dependent upon the specifications for the grade being produced. While the mechanism of the present invention is not completely understood, heat roughening is believed to be due either to fiber debonding and swelling from a very fast water release or to stress relaxation from water imbibition into the fibers. This occurs from a combination of the fast rate of web drying and the fountain solution water used in offset printing. Thus, it is believed that after high moisture finishing, the use of moderate and substantially uniform drying prior to printing permits the previously wet paper fibers to become internally bonded to permanently lock in the desired printing characteristics and thereby reduce the heat roughening effect.

DETAILED DESCRIPTION

Figure 1:
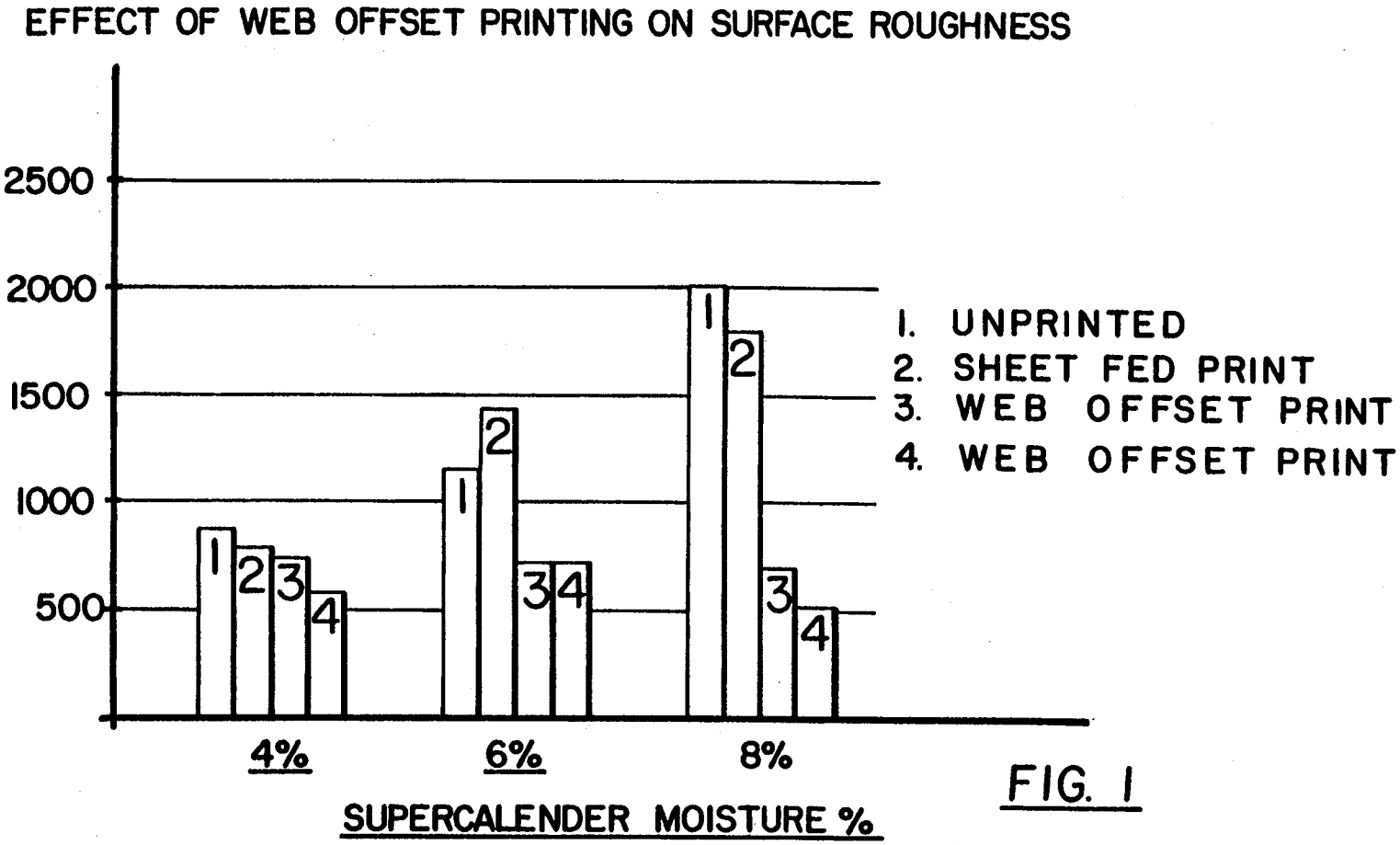
FIG. 1 is a bar chart showing the effect of web offset printing on surface roughening.

Heat roughening is a phenomenon that occurs when paper in web form at a moisture content of more than 3.5% is printed by an offset printing process, or when a web finished at high moisture is post dried under less than optimum conditions. It is a micro size surface phenomenon that may be detected visually, and shows up in smoothness measurements particularly as measured by the Bekk smoothness test. In web offset printing, inks are applied to both surfaces of the paper web simultaneously followed by relatively severe air impingement drying to dry the inks. The heated air impinging on the surface of the web roughens the web and substantially reduces its smoothness if its moisture content is greater than about 3.5%.

In order to overcome the effects of heat roughening upon web offset printing and to provide the printer with a sheet of high gloss and smoothness, the present invention proposes a two step process whereby the web is first finished, either by supercalender or with a synthetic roll calender, at a relatively high moisture content in excess of about 4%, and preferably in the range of from about 4%–10%, and then dried by convection, radiation, or conduction, so as to minimize any loss in finish, to a moisture content of 3.5% or less. The actual moisture content used for finishing will depend upon the temperature, pressure and web speed selected for the finishing step. The initial moisture content selected is a highly important feature of the present invention for achieving a smooth surface initially with high gloss and opacity, since if the finishing step is carried out at too high of a moisture content, a condition may be reached where the web may suffer severe opacity loss, blackening or galvanizing. These conditions are a function of the temperature level and temperature profile in the Z-direction of the web which is achieved in the calendering nip. Thus, the critical moisture content of the web for finishing according to the method of this invention will vary with the type of paper, and with temperature, pressure, web speed and finishing method.

In accordance with the present invention, the initial moisture content of the web entering the supercalender or synthetic roll calender is preferably greater than about 4% but is below the moisture at which blackening, galvanizing or opacity loss might occur. If the finishing apparatus is operated on-machine, it will ordinarily be a simple matter to control the amount of drying on the paper-machine to give the desired moisture content for finishing. When the finishing apparatus is operated off machine, it may, in some instances, be necessary to add moisture to the web before finishing. The maximum permissible moisture content for a given set of conditions, i.e., the moisture content at which the above mentioned detrimental effects might occur, can easily be determined by routine experimentation with the particular paper and finishing apparatus involved. When finishing with a supercalender, typical operating conditions comprise a load of about 1200–2500 pli to yield nip pressures in excess of 2000 psi; a temperature of between about 100–210 degrees F. (steel roll surface temperature); and a web speed on the order of from about 1000–3000 fpmo Loads up to about 4000 pli may be used in the supercalender at greater speeds depending upon equipment availability. For a synthetic roll finishing device comprising one or more heated drums and one or more synthetic soft rolls in nipped relation to a heated drum, typical operating conditions comprise a steel roll surface temperature of about 250°–350° F.; web speed 1000–3500 fpm; and operating loads of 1200–3000 pli to yield nip pressures in excess of 2000 psi. For a synthetic roll calender temperatures up to about 450° F. and web speeds to 5,000 fpm may be acceptable. One or more nips of the supercalender or synthetic roll calender may be used depending upon the type of paper, the coat weight and the finish desired. Some moisture is lost during the finishing step, but in order to achieve the reduction in heat roughening according to the present invention, the web must be post dried to a moisture content of less than about 3.5% after finishing and before printing. Synthetic rolls suitable for the present invention are available from a number of suppliers, and includes rolls identified as Beloit XCC, Kleinewefers Elaplast, Stowe Woodward Plastech A, and Kusters Mat-On-Line.

The post drying step is preferably conducted at a moderate and substantially uniform rate which minimizes any losses in the finish achieved by high moisture finishing. The preferred drying method for existing equipment with space limitations would be a non-impingement method, for example, with the use of IR (Infrared) heaters. However, other drying techniques including air impingement if done under appropriate conditions or the use of a low pressure heated nip (gloss calender) formed by a soft synthetic roll and a heated steel roll have also been found to give satisfactory results. Low pressure in this instance means less than about 2,000 psi for most grades of paper coated or uncoated. The object of the post drying step is to dry the web at a drying rate that may be characterized by the web exit temperature from the drying apparatus so that the web is dried to achieve the internal fiber bonding mentioned before and to prevent fiber debonding upon offset printing. Thus, any known method for drying paper webs may be used in the practice of the present invention if properly configured.

EXAMPLE I

In order to demonstrate the heat roughening effect of the printing surface in a web offset printing press, coated paper was commercially supercalendered with a moisture content of 4%, 6% and 8%. Calendering conditions were 2000 fpm, 1200–1600 pli and 180° F. A first set of this supercalendered paper was printed once using a sheet fed process. Two additional sets were printed twice on different presses by the web offset process. All printing conditions were conducted on the finished paper without post drying. Smoothness of the paper including an unprinted control sample was measured by Bekk. The results are illustrated in FIG. 1.

According to the data in FIG. 1, the unprinted smoothness of coated paper increases with increasing moisture content upon finishing as expected. Meanwhile, the printed smoothness of the sheet fed paper shows little if any change from the unprinted smoothness. That is, there is little or no heat roughening produced by the sheet fed printing process. On the other hand, the printed smoothness of the web fed paper decreases dramatically particularly as the moisture content increases. Thus it may be seen that the web offset printing process produces the heat roughening effect observed during the development of the present invention.

EXAMPLE II

Figure 2:
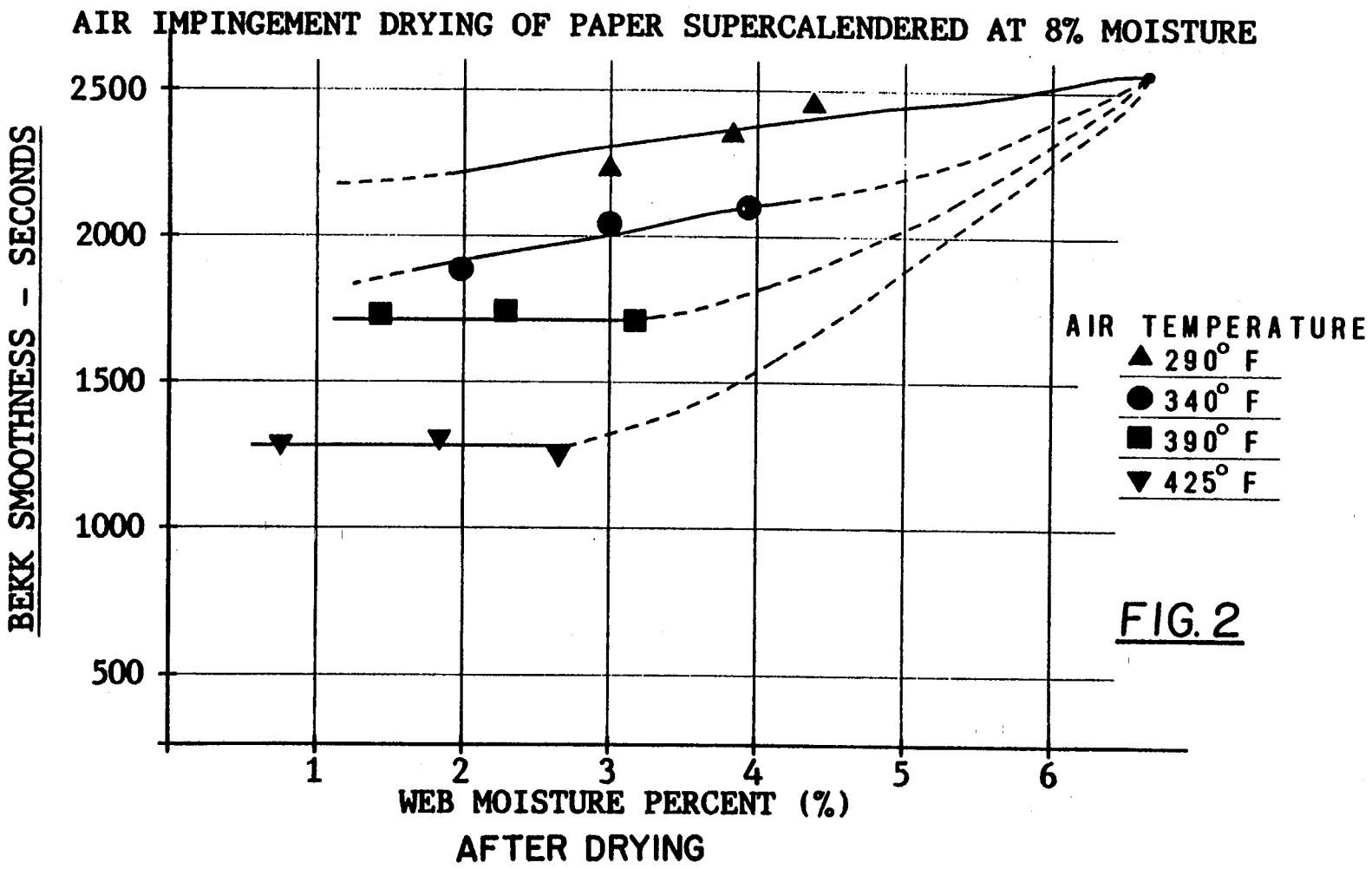
FIG. 2 is a graph showing the effect of air impingement drying on surface smoothness.
Figure 3:
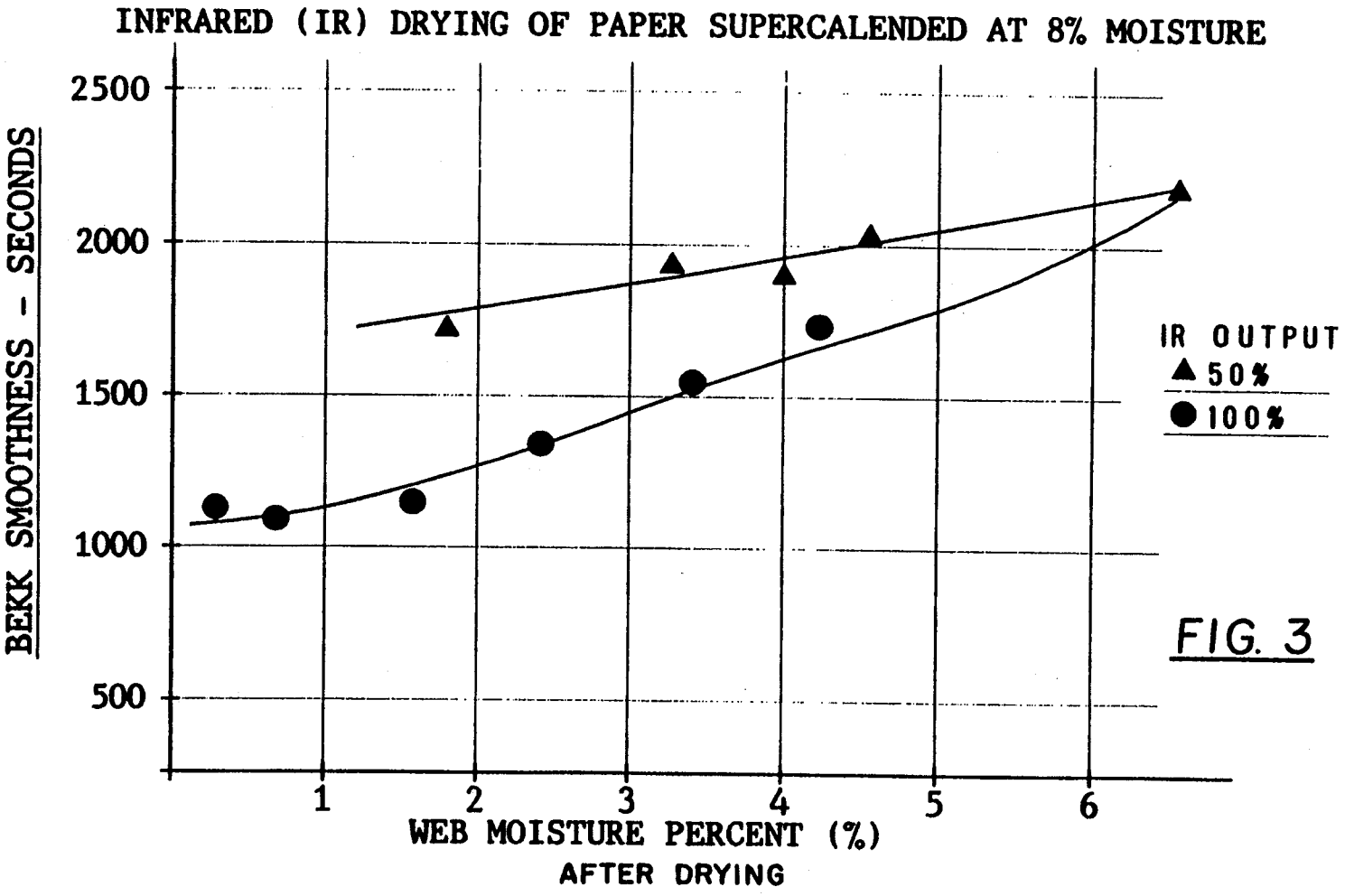
FIG. 3 is a graph showing the effect of non-impact (IR) drying on surface smoothness.

To show the effect of the drying rate on the heat roughening effect, coated paper finished on a supercalender at 8% moisture was post dried by air impingement to simulate print-drying by using the drier of a web offset press. The air temperature was varied over four different conditions (290, 340, 390 and 425 degrees F.) and three different speeds (500, 750 and 1000 fpm) to achieve different drying rates. Paper moisture entering the drier was 6.7% since 1.3% moisture was lost during the supercalendering step. FIG. 2 shows the decrease in Bekk smoothness for each condition of temperature and drying rate (speed). From these results it can be seen that as the temperature of the drier increased, the smoothness of the web decreased at a given moisture content, thus demonstrating that air impingement post drying can roughen a paper surface as might happen on a printing press, with the roughening increasing as the temperature and drying rate increases.

EXAMPLE III

Samples of the same paper used in Example II were dried by IR (Infrared) heaters, a non-impingement drying method, at 59% and 100% output. Paper moisture entering the drier was approximately 6.7%. FIG. III illustrates the effect of drying the web using a non-impingement method, and particularly the reduced degree of roughening that is achieved with a moderate drying rate, i.e., at 59% output of the IR driers as opposed to 100% output. For the paper dried at 100% output, Bekk smoothness decreased from about 2300 to 1100 seconds. Meanwhile at 59% output, Bekk only dropped from about 2300 to about 1800 seconds.

EXAMPLE IV

A printed evaluation of coated web offset printing paper demonstrated the effectiveness of high moisture finishing and post drying according to the present invention. Several paper samples were finished at 4% and 8% moisture on a supercalender. Finishing conditions were 2000 fpm, 180° F. and 1200–1600 pli to achieve a nip pressure in excess of 5000 psi. Some of the samples were then dried by IR at different drying rates to moisture contents ranging from about 2.8% to 3.2%. The post drying conditions and web exit temperatures are shown in Table I. Samples 3–8 had a Bekk smoothness of 2095 before drying. Sample 9 had a Bekk smoothness of 717 before drying. The post-IR web exit temperatures were measured with a non-contact IR pyrometer approximately 1 foot after the exit of the drier. The temperature must be measured a sufficient distance from the drier to eliminate any drier effects which might influence the actual measurement.

TABLE I

| SAMPLE | HIGH MOISTURE FINISHING RADIANT POST DRYING DRYING CONDITION | MOISTURE % $W_i$ | MOISTURE % $W_F$ | BEKK SMOOTHNESS UNPRINTED | BEKK SMOOTHNESS PRINTED | POST DRIER EXIT TEMP °F. |
|---|---|---|---|---|---|---|
| 1 | NONE | 8 | 6.4 | 2095 | 841 | — |
| 2 | NONE | 4 | 4.2 | 717 | 619 | — |
| 3 | 2 Units 100% 600 fpm | 8 | 2.8 | 973 | 1266 | 300 |
| 4 | 1 Unit 100% 180 fpm | 8 | 2.9 | 1214 | 1396 | 260 |
| 5 | 3 Units 65% 600 fpm | 8 | 3.0 | 1284 | 1648 | 285 |
| 6 | 2 Units 45% 180 fpm | 8 | 3.0 | 1619 | 1973 | 270 |
| 7 | 3 Units 35% 180 fpm | 8 | 3.4 | 1969 | 2365 | 205 |
| 8 | 3 Units 100% 1000 fpm | 8 | 3.2 | 1005 | 1403 | 300 |
| 9 | 3 Units 100% 2000 fpm | 4 | 3.2 | 619 | 635 | 250 |

Note:
$W^i$ represents moisture content into finishing device.
$W_F$ represents moisture content after post drying.

Figure 4:
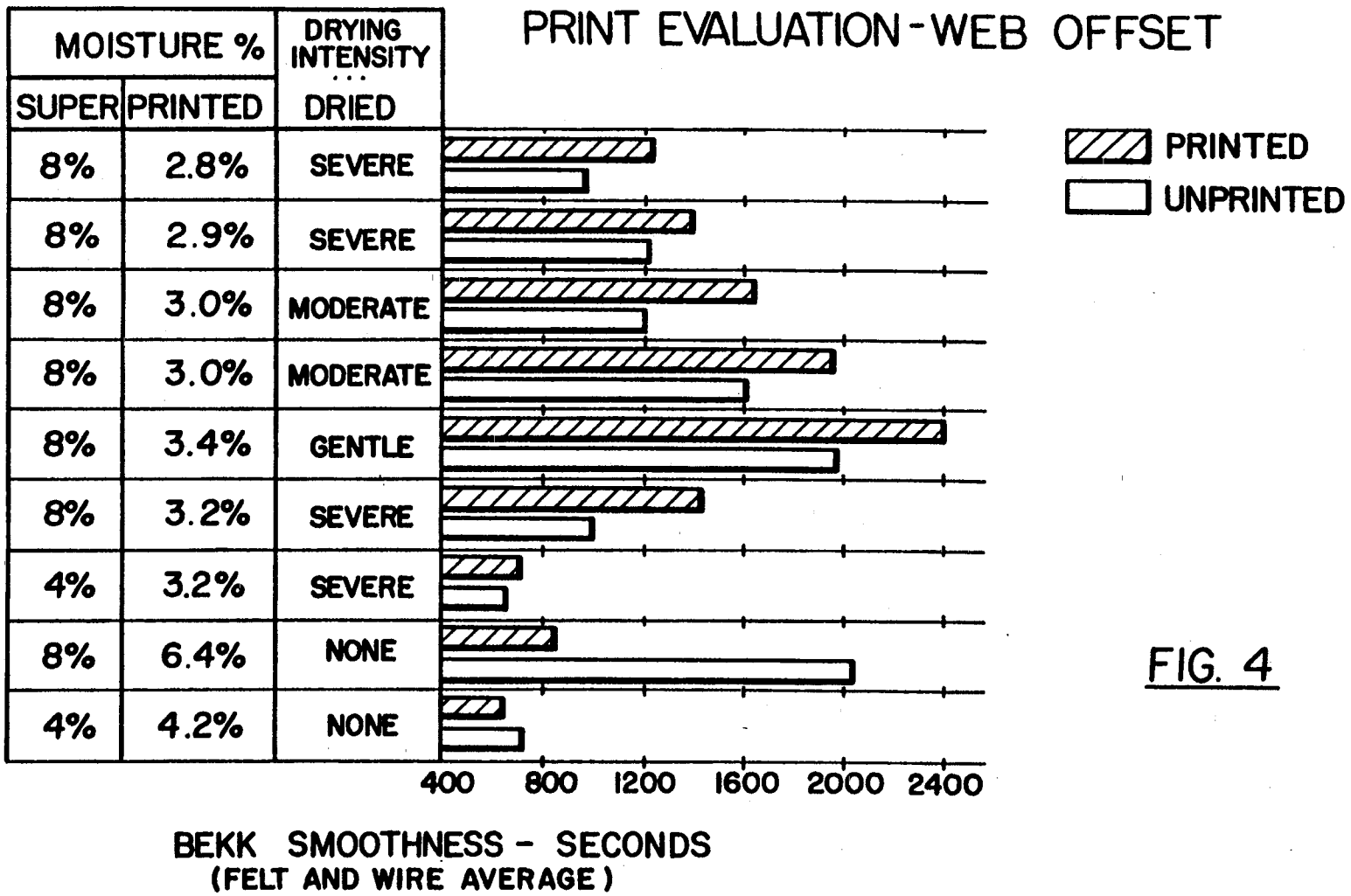
FIG. 4 is a bar chart showing the effect of web offset printing on surface smoothness of paper that is conventionally finished, and then finished and dried before printing according to the present invention; and, FIG. 5 is a schematic illustration of the process according to the present invention.
Figure 5:
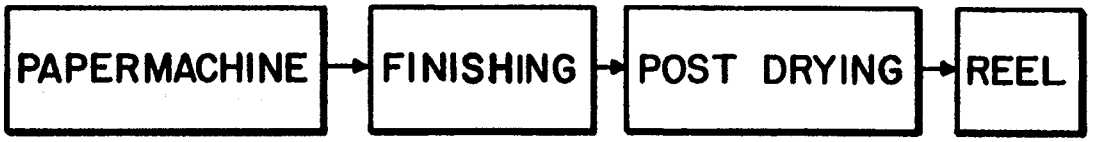

The data in Table 1 and FIG. 4 shows that if the paper is post dried to a moisture content of less than about 3.5% the printed smoothness is almost always greater than the unprinted smoothness. However in this example, severe post drying at a web exit temperature greater than 300° F. substantially reduced the benefits obtained by high moisture finishing (see for example Sample 8 which lost about one half of its original smoothness at a web exit temperature of 300° F.). Therefore, according to the present invention, the use of web exit temperatures to characterize the performance of the present invention is a reasonable approach.

EXAMPLE V

A study was conducted to optimize the effectiveness of various post drying techniques. Paper samples finished by both supercalendering (SC) and synthetic roll calendering (SRC) were post dried by IR, dryer can (CAN) and low pressure gloss calender nip (GC). The GC post drying process used a nip pressure of about 1600 psi, or less than the nip pressure normally used for finishing. The data for a 70 lb. coated web offset paper is shown in Table II. Similar results were obtained for other paper grades. These data indicate that optimum post drying of a web at about 6% moisture using various drying methods can be achieved with web exit temperatures in the range of 200°–260° F. For this example web exit temperatures for the contact post drying methods were measured with a non-contact pyrometer just after the web separated from the heated drum.

TABLE II

| SAMPLE | FINISHING | DRYING METHOD | MOISTURE % $W_i$ | MOISTURE % $W_f$ | BEKK SMOOTHNESS BEFORE | BEKK SMOOTHNESS AFTER | POST DRIER EXIT TEMP °F. |
|---|---|---|---|---|---|---|---|
| | HIGH MOISTURE FINISHING COMPARISON OF RADIANT AND CONDUCTION POST DRYING | | | | | | |
| 1 | SUPER | GC | 6.1 | 2.7 | 944 | 973 | 220 |
| | | CAN | | 2.9 | | 1032 | 200 |
| | | IR | | 3.1 | | 829 | 255 |
| 2 | 300° F. | GC | 6.1 | 2.8 | 1314 | 1650 | 220 |
| | SRC | CAN | | 2.8 | | 1323 | 205 |
| | | IR | | 2.8 | | 1331 | 260 |
| 3 | 350° F. | GC | 6.2 | 3.1 | 1750 | 2048 | 220 |
| | SRC | CAN | | 3.1 | | 1786 | 210 |
| | | IR | | 3.1 | | 1843 | 260 |
| 4. | 400° F. | GC | 6.5 | 3.2 | 1835 | 2128 | 230 |
| | SRC | CAN | | 3.2 | | 2258 | 205 |
| | | IR | | 3.6 | | 2222 | 255 |

As will be apparent to one skilled in the art from the description and examples provided herein, the method of the present invention provides important advantages for the manufacture of web offset printing paper. By virtue of essentially a two step finishing process, the papermaker can provide the printer with high quality paper having exceptional performance on the web offset press. Thus, while the invention has been described in some detail with particular reference to the preferred embodiments, it will be understood that variations and modifications can be effected herein within the spirit and scope of the invention as defined in the appended claims.

What is claimed is:

1. The process of producing a web of paper having high gloss and smoothness and to prevent heat roughening of the web during offset printing which comprises:

(a) finishing a paper web in a finishing device at a nip pressure of at least about 2,000 psi and a moisture content in the range of from about 4%–10% by weight of the paper to enhance the gloss and smoothness of the web; and, (b) post drying the web after finishing to a moisture content of less than about 3.5% without substantially negating the enhanced gloss and smoothness obtained in step (a).

2. The process of claim 1 wherein the finishing device of step (a) comprises a supercalender apparatus consisting of a plurality of hard rolls and soft rolls wherein the web is passed through at least one nip formed between said hard and soft rolls.

3. The process of claim 2 wherein at least one of the hard rolls in the supercalender is heated.

4. The process of claim 1 wherein the finishing device of step (a) comprises a smooth hard finishing roll and at least one resilient backing roll wherein the web is passed through at least one nip formed between said finishing roll and said backing roll.

5. The process of claim 4 wherein the finishing device of step (a) comprises a second smooth hard finishing roll and at least one additional resilient backing roll wherein the web is passed through at least one nip formed between said second finishing roll and said additional resilient backing roll and at least one of the hard finishing rolls is heated.

6. The process of claim 5 wherein the post drying device of step (b) comprises at least one gloss calendar nip at a nip pressure of less than about 2000 psi and a temperature of between about 100° and 400° F.

7. The process of claim 1 wherein the post drying step (b) is selected from the group consisting of convection, radiation or conduction.

8. The process of claim 1 wherein the moisture content of the web in step (a) is in the range of from about 6–8% by weight of the paper.

9. The process of finishing web offset printing paper to prevent heat roughening of the web upon offset printing comprising:

(a) finishing a paper web in a finishing device at a pressure in excess of about 2000 psi and at a moisture content in the range of from about 4–10% by weight of the paper to enhance the gloss and smoothness of the web; and, (b) post drying the web after finishing to a final moisture content of less than about 3.5% at a drying rate constant as determined by the formula:

$$K(hr^{-1}) = ln(W_o/W_f)t^{-1}$$

where $W_o$ and $W_f$ are the initial and final moisture contents of the web as measured in lb/ream and t is the residence time of drying, said drying rate constant being selected to achieve a web exit temperature that will permit the web to retain at least about 50% of the enhanced gloss and smoothness obtained in step (a).

10. The process of claim 9 wherein the post drying process of step (b) is selected from the group consisting of convection, radiation and conduction.

11. The process of claim 10 wherein the finishing device of step (a) is selected from the group consisting of a supercalender or a resilient roll gloss calender.

12. A method for preparing a paper web for use on an offset press which will not experience heat roughening during offset printing comprising drying the web to a moisture content of 3.5% or less before printing.

13. The process of finishing web offset printing paper to provide high gloss and smoothness, and drying the finished web so as to prevent heat roughening of the web during web offset printing comprising:

(a) finishing a paper web in a finishing device comprising a first smooth hard finishing roll and at least one resilient backing roll, wherein the web is passed through at least one nip formed between said first finishing roll and said backing roll, and a second smooth hard finishing roll and at least one additional resilient backing roll, wherein the web is passed through at least one nip formed between said second finishing roll and said additional resilient backing roll, at a nip pressure of at least about 2,000 psi and a moisture content in the range of from about 4–10% by weight of the paper, wherein at least one of said finishing rolls is heated to a surface temperature in excess of about 250° F. to enhance the gloss and smoothness of the web; and, (b) post drying the web after finishing to a moisture content of less than about 3.5% at a web exit temperature of less than about 300° F. without substantially negating the enhanced gloss and smoothness obtained in step (a).

14. The process of claim 13 wherein the drying step (b) is carried out at a temperature in the range of from about 200°–260° F.

15. The process of claim 14 wherein the drying step (b) is selected from the group consisting of convection, radiation and conduction.

16. The process of finishing web offset printing paper to provide high gloss and smoothness, and drying the finished web so as to prevent heat roughening of the web during web offset printing comprising: (a) finishing a paper web in a finishing device comprising a supercalender apparatus consisting of a plurality of hard rolls and soft rolls wherein the web is passed through at least one nip formed between said hard and soft rolls, at a nip pressure of at least about 2,000 psi and a moisture content in the range of from about 4–10% by weight of the paper, wherein at least one of said hard rolls is heated to a surface temperature in the range of from about 100°–200° F. to enhance the gloss and smoothness of the web; and, (b) post drying the web after finishing to a moisture content of less than about 3.5% at a web exit temperature of less than about 300° F. without substantially negating the enhanced gloss and smoothness obtained in step (a).

17. The process of claim 16 wherein the drying step (b) is carried out at a temperature in the range of from about 200°–260° F. and the drying step (b) is selected from the group consisting of convection, radiation and conduction.

* * * * *